US006874654B2

(12) United States Patent
Kish et al.

(10) Patent No.: US 6,874,654 B2
(45) Date of Patent: Apr. 5, 2005

(54) APPARATUS FOR EXCHANGING BOBBINS

(75) Inventors: Thomas G. Kish, Del Rio, TX (US); Ramiro Ramirez, Coahuila (MX); Francisco Medellin, Coahuila (MX); Richard Quintela, Del Rio, TX (US)

(73) Assignee: Intier Automotive Inc., Aurora (CA)

( * ) Notice: Subject to any disclaimer, the term of this patent is extended or adjusted under 35 U.S.C. 154(b) by 124 days.

(21) Appl. No.: 10/070,495

(22) PCT Filed: Jul. 9, 2001

(86) PCT No.: PCT/US01/21692

§ 371 (c)(1),
(2), (4) Date: Jun. 10, 2002

(87) PCT Pub. No.: WO02/04721

PCT Pub. Date: Jan. 17, 2002

(65) Prior Publication Data

US 2002/0153385 A1 Oct. 24, 2002

Related U.S. Application Data

(60) Provisional application No. 60/216,841, filed on Jul. 7, 2000.

(51) Int. Cl.[7] ..... A47F 1/04

(52) U.S. Cl. ..... 221/66; 221/161; 194/205; 194/233

(58) Field of Search ..... 221/66, 161; 194/205, 194/233, 234, 235

(56) References Cited

U.S. PATENT DOCUMENTS

| | | | | |
|---|---|---|---|---|
| 1,440,295 A | | 12/1922 | Herr | |
| 2,245,841 A | | 7/1941 | Weiss | |
| 2,442,025 A | | 5/1948 | Smith | |
| 2,682,328 A | | 6/1954 | Birr | |
| 2,891,697 A | | 6/1959 | Beckers | |
| 2,977,006 A | | 3/1961 | Curry | |
| 3,171,568 A | | 3/1965 | Arwine | |
| 3,365,048 A | | 1/1968 | Ehrlich et al. | |
| 3,517,797 A | | 6/1970 | Daleffe et al. | |
| 3,604,553 A | * | 9/1971 | Haehnel | 198/400 |
| 3,672,542 A | * | 6/1972 | Cruickshank et al. | 221/161 |
| 3,681,906 A | * | 8/1972 | Burgermeister et al. | 57/274 |
| 3,734,347 A | * | 5/1973 | Dunbar | 221/134 |
| 3,809,287 A | * | 5/1974 | Muller-Scherak | 221/66 |

(Continued)

FOREIGN PATENT DOCUMENTS

| | | | | |
|---|---|---|---|---|
| EP | 0518817 A1 | * | 5/1992 | D01H/9/18 |
| JP | 03-180526 A | * | 8/1991 | B65H/67/04 |
| JP | 4-23747 A | * | 1/1992 | B65H/3/48 |

*Primary Examiner*—Donald P. Walsh
*Assistant Examiner*—Michael C Butler
(74) *Attorney, Agent, or Firm*—Clark Hill PLC

(57) ABSTRACT

An apparatus for dispensing a fully threaded bobbin to an operator upon the depositing of an empty bobbin into the apparatus. The apparatus comprises a housing defining a storage compartment for storing the bobbins. The housing has a first opening for depositing the empty bobbins therein and a second opening for dispensing the full bobbins therefrom. A tray is mounted to the housing within the storage compartment for orienting and feeding fully threaded bobbins and a top and bottom slide are provided for transporting the full bobbins from the tray to the second opening. An actuator lever is slidably coupled to a lever channel for activating the apparatus. A release hinge is mounted to the top slide and operatively coupled to the acutator lever for releasing a single full bobbin from the top slide and to the second opening in response to the actuator lever being activated from a fully extended position to an actuated position and an empty bobbin being deposited into the first opening and lever channel. An accommodator is operatively coupled between the actuator lever and the try for orienting the bobbins for transportation in the top slide for cooperation with the release hinge.

12 Claims, 5 Drawing Sheets

U.S. PATENT DOCUMENTS 3,833,146 A * 9/1974 Braginetz ..... 221/66
4,099,609 A * 7/1978 Kieronski et al. ..... 198/395
4,340,187 A * 7/1982 Schippers et al. ..... 242/473.7
4,583,358 A * 4/1986 Krieger et al. ..... 57/281
4,650,062 A * 3/1987 Uchida ..... 198/468.2
4,657,194 A * 4/1987 Wey et al. ..... 242/473.4
4,720,967 A * 1/1988 Guttler ..... 57/281
4,899,531 A * 2/1990 Mack ..... 57/281
4,998,857 A * 3/1991 Paravella et al. ..... 414/331.03
5,272,865 A * 12/1993 Sasaki et al. ..... 57/281
5,402,872 A 4/1995 Clurman
5,451,005 A * 9/1995 Lochbronner ..... 242/473.6
5,590,811 A * 1/1997 Hill ..... 221/89
5,829,630 A 11/1998 Fernald

* cited by examiner

APPARATUS FOR EXCHANGING BOBBINS

This application claims the benefit of provisional application No. 60/216,841, filed Jul. 7, 2000.

BACKGROUND OF THE INVENTION

1. Field of the Invention

The present invention relates to an apparatus for dispensing a filled, or threaded, bobbin when an empty bobbin is deposited into the apparatus.

2. Description of the Related Art

Bobbins are used in the sewing industry to supply thread to a sewing machine. Thread is pre-wound onto the bobbin, and the bobbin is then placed on the sewing machine. The thread is pulled from the bobbin as the machine functions. Bobbins are useful in that the amount of thread and type of thread can be controlled. Specifically, a bobbin can be pre-wound with a pre-determined quantity of thread to minimize waste, and make changing a machine from one sewing job to another more efficient.

A problem associated with the use of bobbins in this manner is controlling the inventory of new and used bobbins. As known in the art, when the thread on a bobbin is exhausted, the empty bobbin may be re-used. Specifically, new thread may be wound onto the used, empty bobbin and the bobbin can then be re-circulated with a different type and/or amount of thread. Empty bobbins, however, are sometimes carelessly discarded or lost, thereby depleting the supply of empty bobbins to be re-used.

Therefore, it is desirable to provide an apparatus for dispensing a filled, or re-threaded, bobbin, once an empty bobbin has been exhausted and deposited into the apparatus.

SUMMARY OF THE INVENTION

According to one aspect of the invention, an apparatus is provided for dispensing a fully threaded bobbin to an operator upon the depositing of an empty bobbin into the apparatus. The apparatus comprises a housing defining a storage compartment for storing the bobbins. The housing has a first opening for depositing the empty bobbins therein and a second opening for dispensing the full bobbins therefrom. A tray is mounted to the housing within the storage compartment for orienting and feeding fully threaded bobbins. At least one slide is provided for transporting the full bobbins from the tray to the second opening. An actuator lever is slidably coupled to the housing for activating the apparatus. A release hinge is mounted to a portion of the slide and operatively coupled to the actuator lever for releasing a single full bobbin from the slide and the second opening in response to the actuator lever being activated from a fully extended position to an actuated position and an empty bobbin being deposited into the first opening. An accommodator is operatively coupled between the actuator lever and the tray for orienting the bobbins for transportation in the slide for cooperation with the release hinge.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
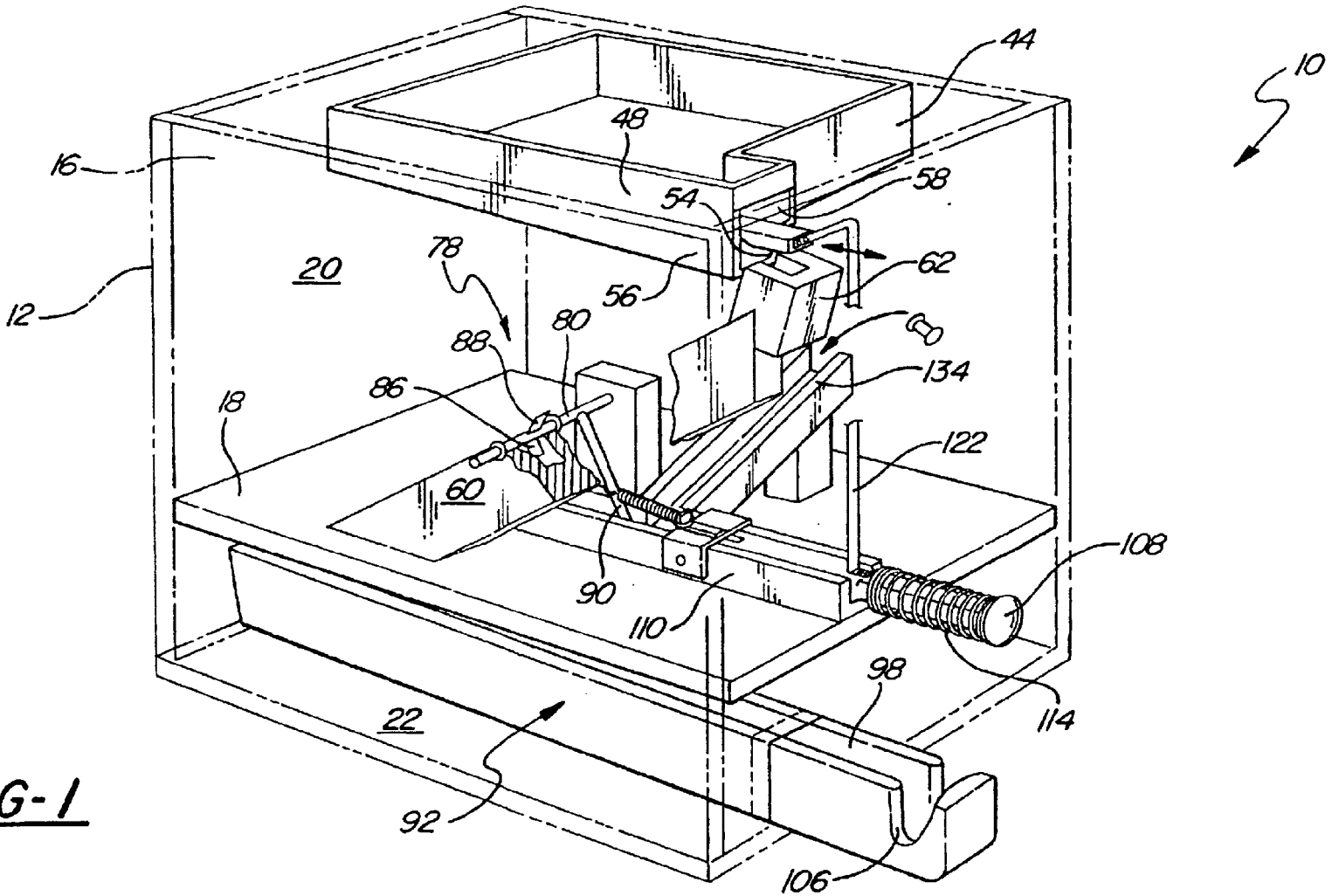
FIG. 1 is a perspective view of a bobbin dispenser in accordance with the present invention.

Referring to the Figures, wherein like numerals indicate like or corresponding parts throughout the several views, a bobbin dispenser apparatus of the present invention is generally shown at 10 in FIG. 1.

The dispenser 10 includes a housing 12 that defines a storage compartment 14. The housing 12 can be made from any material such as steel, plastic, wood, or the like. The housing 12 includes a top 16 which is either removable, or in the alternative, hinges in such a way that the top 16 can be opened up to allow access to the compartment 14. A center divider 18 is disposed in the compartment 14 and is supported by the housing 12 such that the compartment 14 is divided into an upper compartment 20 and a lower compartment 22.

Figure 2:
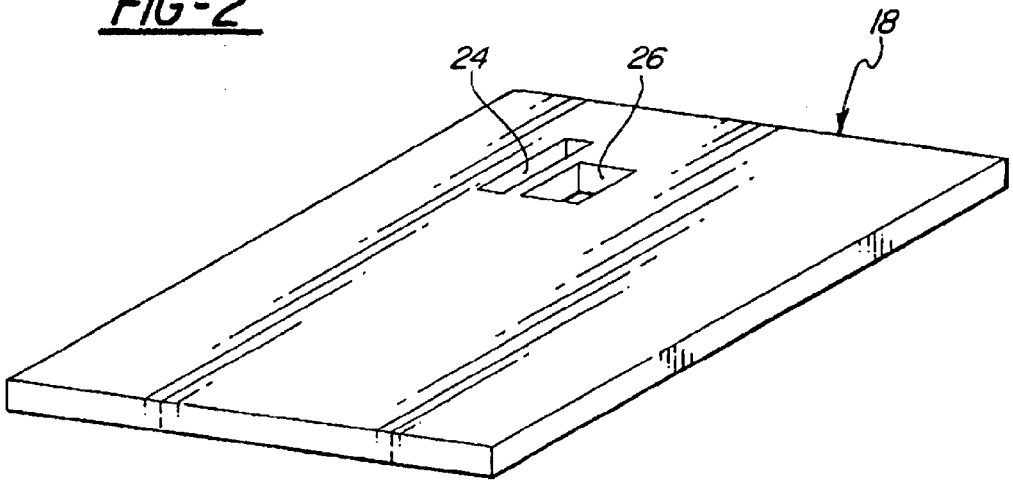
FIG. 2 is a perspective view of a center divider.

Referring to FIG. 2, the center divider 18 includes a full bobbin opening 24 for allowing bobbins to fall from the upper compartment 20 into the lower compartment 22 as will be discussed below. The center divider 18 further includes an empty bobbin opening 26 located adjacent to the full bobbin opening 24, the function of which is discussed below.

Figure 3:
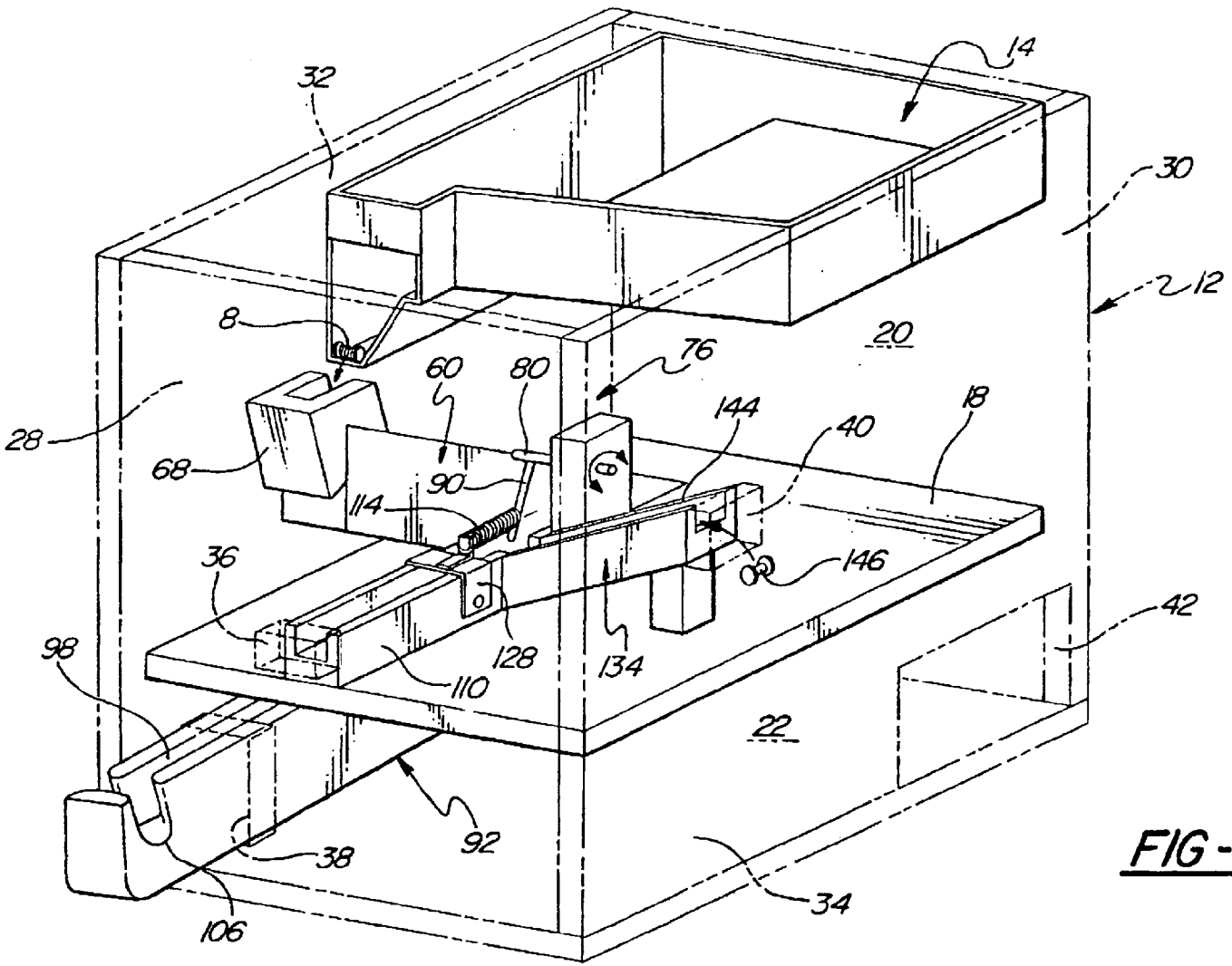
FIG. 3 is another perspective view of the bobbin dispenser shown with a tray removed.

As best shown in FIG. 3, the housing 12 further includes a first planar wall 28 and a second planar wall 30 opposite the first wall 28. The first 28 and second 30 walls are interconnected by a third planar wall 32 and an opposite fourth planar wall 34. The walls 28, 30, 32, 34 define the storage compartment 14 and support the center divider 18 between the upper and lower compartments 20, 22. A first opening 36 and a second opening 38 are formed in the first wall 28. The first opening 36 communicates with the upper compartment 20 of the compartment 14 and the second opening 38 communicates with the lower compartment 22 of the compartment 14. A third opening 40 and a fourth opening 42 are formed in the fourth wall 34 and are in communication with the upper compartment 20 and the lower compartment 22, respectively.

As discussed in the background section, bobbins as shown at 8, which are pre-wound with thread, are used in the sewing industry to supply thread to a sewing machine. The dispenser 10 is designed to accept a used bobbin, i.e. a bobbin without thread, and dispense a new or full bobbin, i.e. a bobbin with thread. In particular, the used bobbin is inserted into the third opening 40 and the full bobbin is dispensed out the second opening 38. The specifics of how the bobbin is dispensed and the working components of the dispenser 10 are discussed in greater detail below.

Figure 4:
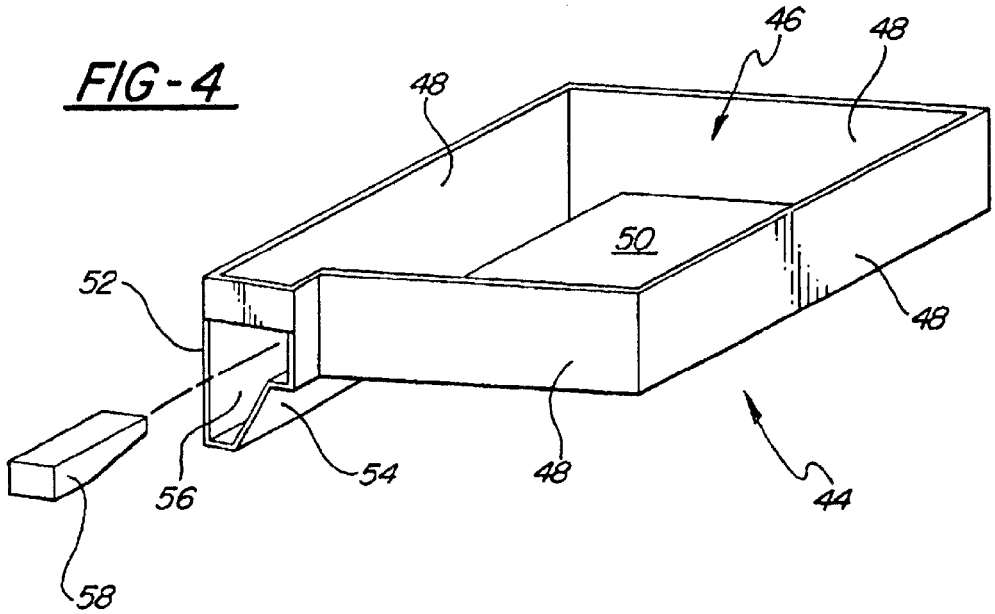
FIG. 4 is a perspective view of the tray.

Referring again to FIG. 1, the dispenser 10 includes a tray 44 that holds and orients the full bobbins 8 in the upper compartment 20. The tray 44 is mounted above the divider 18 and supported by the side walls 28, 30, 32, 34. As best shown in FIG. 4, the tray 44 includes a reservoir 46 defined by sidewalls 48 and a bottom 50 for holding the full bobbins. The bobbins 8 are placed to move in a rolling orientation in order to be easily dispensed from the tray 44. The reservoir 46 is tilted to cause the full bobbins 8 to roll along the bottom 50 toward a release channel 52. The release channel 52 runs along one side of the tray 44 and includes an angled, or ramped, sidewall 54 to assist in aligning the full bobbins in a manner to be dispensed. The tray 44 also includes an opening 56 in the sidewall 48 adjacent the end of the release channel 52 for insertion of an accommodator 58. The accommodator 58 is a wedge shaped block slidably supported by the housing 12 for movement in and out of the opening 56 so as to assist in orienting the dispensing of the bobbins as is further discussed below.

Figure 5:
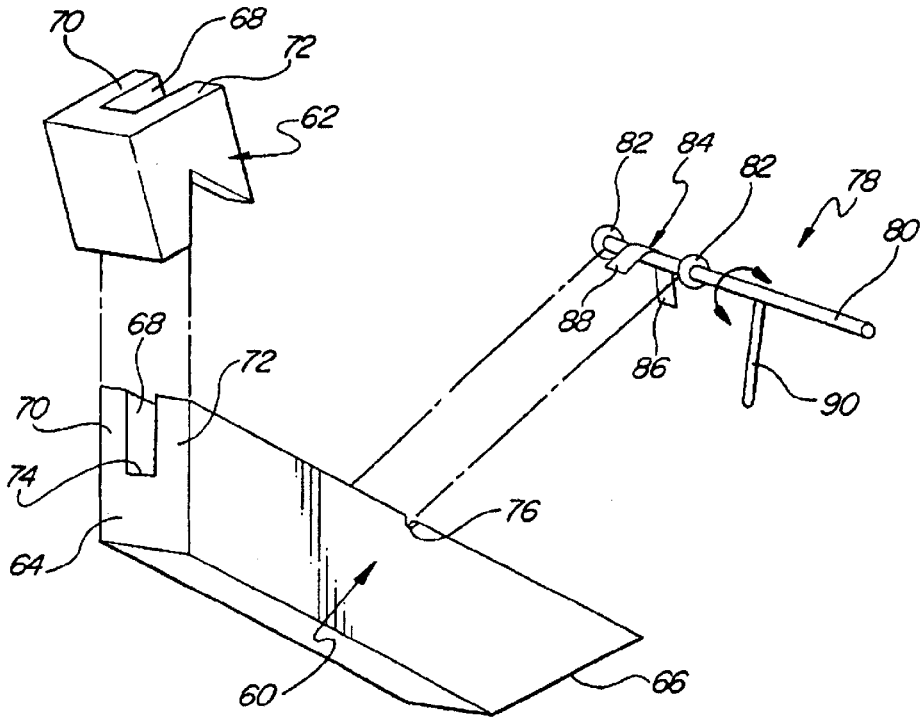
FIG. 5 is an exploded perspective view of a top slide and related components.

Referring also to FIG. 5, full bobbins are fed from the tray 44 to a top slide 60. An upper guide 62 is mounted to an upper end 64 of the top slide 60 to assist in guiding the full bobbins from the release channel 52 to within the top slide 60. A lower end 66 of the top slide 60 is mounted to the center divider 18 over the full bobbin opening 24.

The top slide 60, including the attached upper guide 62, includes a generally U-shaped channel 68 defined by first and second side walls 70, 72 and a floor 74 extending between the side walls 70, 72. The floor 74 is slightly wider than the thickness of a bobbin standing on edge. In particular, the floor 74 is wide enough to allow the bobbin to freely roll thereon and is narrow enough to prevent the bobbin from toppling over so as to keep the bobbin on its edge, thereby allowing the bobbin to roll. The full bobbin opening 24, show in FIG. 2, is of a complementary width to the floor 74 such that a bobbin can fall through the opening 24 and into the lower compartment 22 while maintaining its rolling orientation.

The top slide 60 further includes an arcuate groove 76 formed in each of the side walls 70, 72 approximately half way between the upper end 64 and the lower end 66 of the top slide 60. A release hinge 78 is disposed in the groove 76 perpendicular to the longitudinal length of the top slide 60. The release hinge 78 includes a lateral bar 80 having a pair of spaced apart bushings 82. The bar 80 is seated in the groove 76 with the bushings 82 straddling the side walls 70, 72 so as to limit lateral movement of the release hinge 78.

A valve 84 is mounted to the lateral bar 80 between the bushings 82. The valve 84 is an arcuate shaped member made of metal, plastic or the like. The valve 84 has a major portion 86 that hangs from the lateral bar 80 towards the lower end 66 of the top slide 60, and a minor portion 88 that hangs from the lateral bar 80 towards the upper end 64 of the top slide 60. As is discussed below, the valve 84 is used to control the movement of the bobbins in the channel 68.

An actuation rod 90 extends downwardly from the lateral bar 80 and outside of the channel 68 and along side of the side walls 70, 72. The actuation rod 90 is used to rotate the lateral bar 80 and valve 84 to facilitate releasing the bobbins one at a time from the top slide 60.

Figure 6:
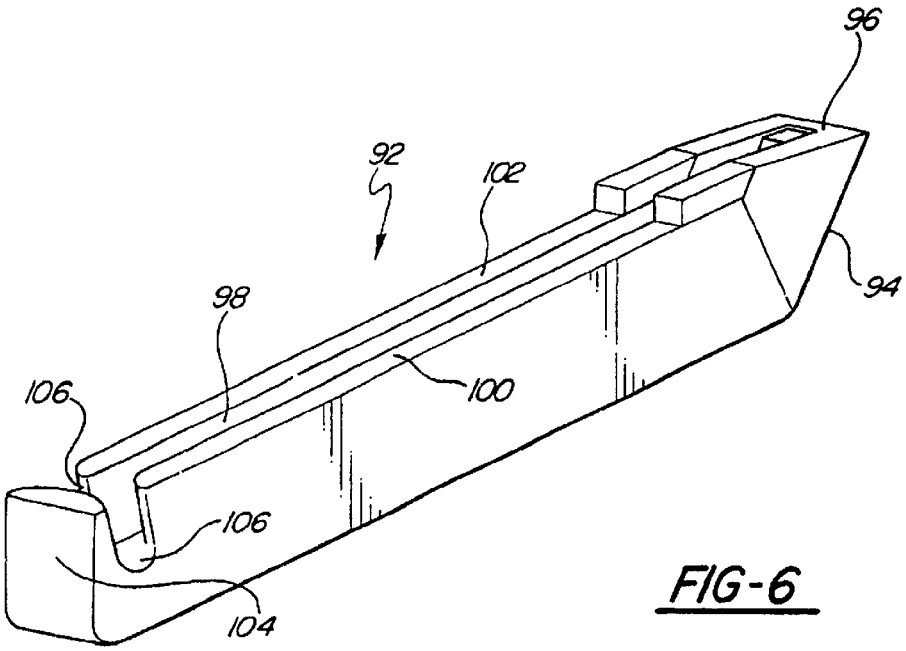
FIG. 6 is a perspective view of a bottom slide.

Referring to FIGS. 1 and 3, a bottom slide 92 is mounted within the lower compartment 22 of the dispenser 10. As best shown in FIG. 6, an upper end 94 of the bottom slide 92 includes a lower guide 96 for connecting the bottom slide 92 to the center divider 18 opposite the lower end 66 of the top slide 60. The lower guide 96 is therefore aligned with the full bobbin opening 24 in the center divider 18. The bottom slide 92 includes a channel 98 defined between spaced apart sidewalls 100, 102, similar to the channel 68 within the top slide 60, for maintaining the bobbin on its edges and thus allowing the bobbin to roll downward.

A lower end 104 of the bottom slide 92 extends through the second opening 38 within the second wall 30. The lower end 104 includes U-shaped cutouts 106 in each sidewall 100, 102 to allow an operator to retrieve a full bobbin that has been dispensed.

Figure 7:
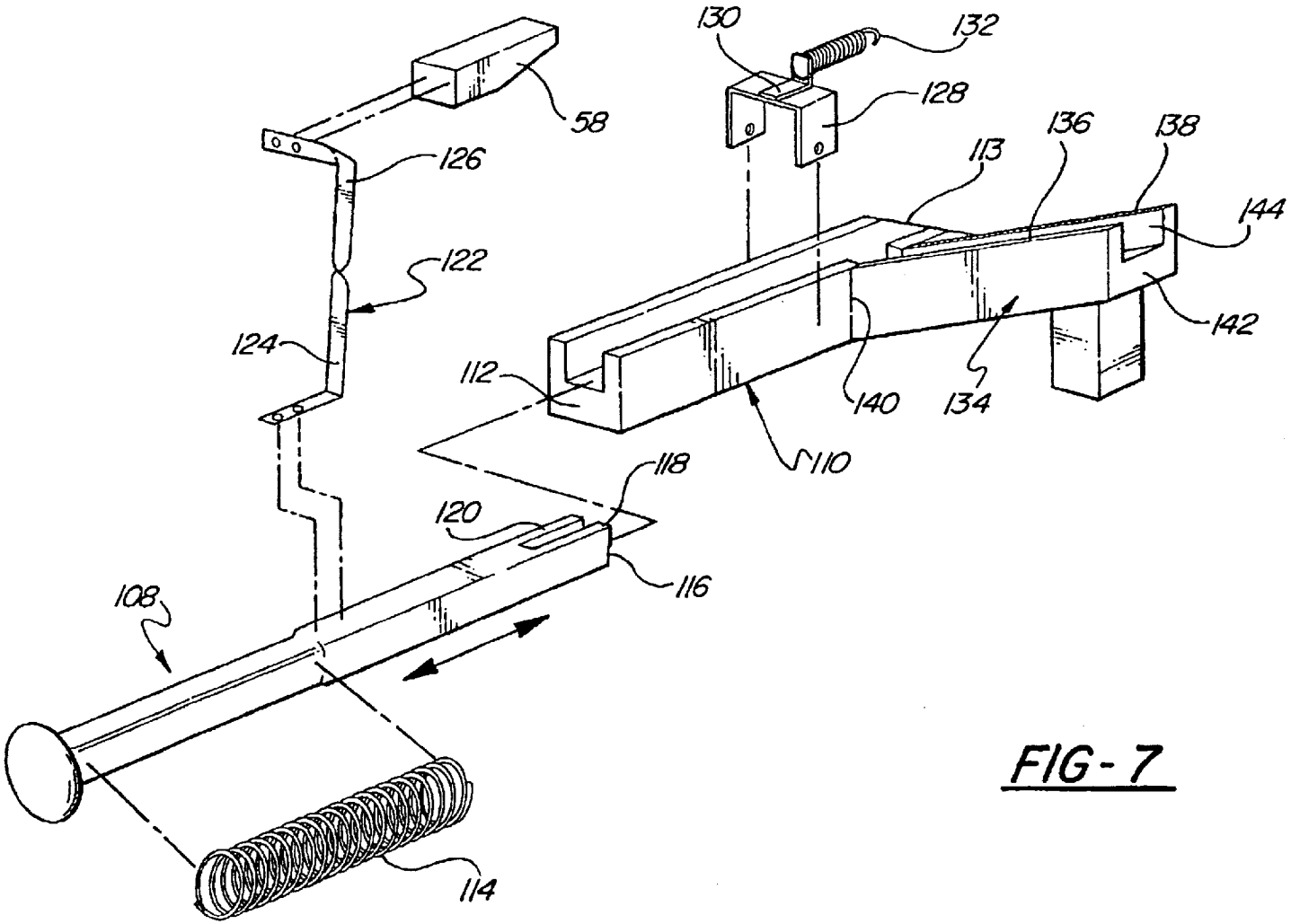
FIG. 7 is an exploded perspective view of a lever channel and related components.

As shown in FIG. 1, the dispenser 10 includes an actuator lever 108 to facilitate the release of a bobbin from the dispenser 10 once an empty bobbin has been inserted into the third opening 40. As best shown in FIG. 7, the actuator lever 108 rests within a lever channel 110, defined by spaced apart and parallel sidewalls extending between a front end 112 and rear end 113. As shown in FIG. 3, the lever channel 110 is supported by the divider 18 within the upper compartment 20. Referring to FIGS. 3 and 7, the front end 112 of the lever channel 110 mates with the inside of the first wall 28 and aligns with the first opening 36 therein. The actuator lever 108 is slidably disposed into the upper compartment 20 through the first opening 36 for movement between a fully extended position and an actuated position. A lever spring 114 is disposed about the lever 108 and between opposite ends thereof for biasing the lever 108 outwardly from the compartment 14 to the fully extended position. The actuator lever 108 also includes a forked end 116 defined by spaced apart and parallel fingers 118, 120 that is located within the lever channel 110.

An accommodator bracket 122 including opposing L-shaped ends 124, 126 is mounted to the top side of the actuator lever 108 by the end 124. The accommodator 44 is mounted to the other end 126 of the accommodator bracket 122 opposite the actuator lever 108, and aligns with the accommodator opening 56 in the tray 44, as shown in FIG. 4.

An actuation spring support bracket 128 is fixedly mounted to the sidewalls of the lever channel 110. The actuation spring support bracket 128 straddles the lever channel 110 and includes a mounting clip 130. An actuation spring 132, such as a compression coil spring, interconnects the clip 130 and the distal end of the actuation rod 90 opposite the lateral bar 80, as shown in FIG. 3. The actuation spring 132 biases the release hinge 78 to a starting position where the major portion 86 of the valve 84 is rotated downwardly into the channel 68 of the top slide 60. When hinge 78 is in the starting position, the actuation rod 90 extends into the lever channel 110.

An empty bobbin slide 134 attaches generally perpendicularly to the lever channel 110. The empty bobbin slide 134 includes spaced apart and parallel sidewalls 136, 138 extending between first and second ends 140, 142 defining a channel 144 therebetween for receiving a bobbin. The first end 140 is connected to the sidewall of the lever channel 110 adjacent the rear end 113 and the opposite second end 142 is connected to the fourth wall 42 and aligned with the third opening 40 therein. The rear end 113 of the lever channel 110 ends directly aligned with the empty bobbin opening 26 in the center divider 18.

In operation, the tray 44 of the dispenser 10 is initially filled with full bobbins 8. At least a few of the full bobbins fall into the release channel 52 and subsequently roll down the top slide 60 until stopped by the major portion 86 of the valve 84. Specifically, when a bobbin rolls down the channel 68, the bobbin rolls under the minor portion 88 and is stopped by the major portion 86.

A user may deposit an empty bobbin 146 through the third opening 40 and into the empty bobbin slide 134 such that the bobbin is standing on an end face. When the actuator lever 108 is in the fully extended position, the forked end 116 is biased to a position closest to the front wall 28 which is behind the point where the empty bobbin slide 134 mates with the lever channel 110. In addition, the release hinge 78 is in the starting position with the distal end of the actuation rod 90 extending into the lever channel 110 in front of the point where the empty bobbin slide 134 mates with the lever channel 110. Therefore, when the empty bobbin is deposited to the empty bobbin slide 134, the bobbin will slide downward on its end face and topple over on its edges into the lever channel 110 in front of the forked distal end 116 and behind the distal end of the actuation rod 90. The channels and intersection of the empty bobbin slide 134 and the lever channel 110 are configured such that when the empty bobbin reaches the lever channel 110, the bobbin is positioned in a rolling orientation.

To receive a new full bobbin, the operator activates the actuator lever 108 to move the lever 108 to the actuated position. Specifically, the operator pushes the actuator lever 108 toward the first wall 28 against the bias of the lever spring 114. As the actuator lever 108 advances, the forked end 116 slides forward to contact the empty bobbin that is standing in the lever channel 110. Upon further advancement of the lever 108, the forked end 116 extends to the rear end 113 of the lever channel 110, thereby pushing the empty bobbin past the rear end 113 and causing the empty bobbin to fall through the empty bobbin opening 26 and into the lower compartment 22.

As the empty bobbin is pushed along the lever channel 110 toward the rear end 113, the empty bobbin contacts the distal end of the actuation rod 90 and causes the release hinge 78 to rotate counter-clockwise as viewed by FIGS. 3 and 5. The counter-clockwise rotation rotates the lateral bar 80 such that the major portion 86 of the valve 84 is rotated upward and out of the channel 68. Simultaneously, the minor portion 88 is rotated downward into the channel 68. The minor portion 88 lowers into the channel 68 in front of a subsequent full bobbin directly behind the bobbin held by the major portion 86 of the valve 84. After the major portion 86 is rotated fully upward and out of the channel 68, a single full bobbin will roll freely down the channel 68 while all the other full bobbins stacked behind are being held by the minor portion 88 of the valve 84.

The single full bobbin rolls forward down the remainder of the top slide 60, until the bobbin falls downward through the full bobbin opening 24. The bobbin is then caught by the lower guide 96 which delivers the bobbin further downward into bottom slide 92. The bobbin rolls down through bottom slide 92 and exists out the first opening 36 into the cutouts 80 for retrieval by an operator. The remaining full bobbins continue to be held in place by the minor portion 88 of the valve 84.

Once the empty bobbin has been pushed beyond the rod 90, the actuation spring 134 causes the actuation rod 90 to snap back to the starting position. Hence, the lateral bar 80 rotates clockwise back to the starting position. The major portion 86 of the valve 84 will rotate back downward into the channel 68, and the minor portion 88 will rotate upward out of the channel 68. The subsequent full bobbins within the channel 68 will roll forward until the first bobbin rests against the major portion 86 of the valve 84.

Simultaneously with the actuation of the actuator lever 108, the accommodator 58 is forced into the accommodator opening 56 and into the supply of bobbins. The accommodator 58 helps to shift the bobbins so the bobbins may fall within the release channel 52 and become correctly oriented such that they may roll forward to the top slide 60.

The actuation of the actuator lever 108 therefore deposits an empty bobbin into the lower compartment 22 while simultaneously releasing a single full bobbin for retrieval by the operator. Actuation of the actuator lever 108 without first depositing an empty bobbin will not release a full bobbin. Without an empty bobbin placed in the lever channel 110, the forked distal end 116 will pass underneath the actuation rod 90. Hence, the empty bobbin acts as a coupler to couple the forked distal end 116 to the actuation rod 90.

Once the actuator lever 108 has been fully actuated, the empty bobbin has dropped into the empty bobbin opening 26, and the fill bobbin has been dispensed, the operator will release the actuator lever 108. The lever spring 114 automatically biases the lever 114 to the original starting position such that the dispensing operation may be repeated.

The invention has been described in an illustrative manner, and it is to be understood that the terminology, which has been used, is intended to be in the nature of words of description rather than of limitation.

Many modifications and variations of the present invention are possible in light of the above teachings. It is, therefore, to be understood that within the scope of the appended claims, the invention may be practised other than as specifically described.

What is claimed is:

1. An apparatus for dispensing a fully threaded bobbin to an operator upon the depositing of an empty bobbin into the apparatus, said apparatus comprising:

a housing defining a storage compartment for storing the bobbins, said housing having a first opening for depositing the empty bobbins therein and a second opening for dispensing the full bobbins therefrom;

a tray mounted to said housing within said storage compartment for orienting and feeding fully threaded bobbins;

a top slide for transporting the full bobbins from said tray to said second opening;

an actuator lever slidably coupled to said housing for activating said apparatus;

a release hinge mounted to a portion of said slide and operatively coupled to said actuator lever for releasing a single full bobbin from said slide and said second opening in response to said actuator lever being activated from a fully extended position to an actuated position and an empty bobbin being deposited into said first opening;

an accommodator operatively coupled between said actuator lever and said tray for orienting the bobbins for transportation in said slide for cooperation with said release hinge;

a lever channel supported by said housing for slidably receiving and guiding said actuator lever between said fully extended position and said actuated position; and an empty bobbin slide connected between said lever channel and said first opening for transporting and depositing an empty bobbin into said lever channel for engagement with said actuator lever and said release hinge.

2. An apparatus as set forth in claim 1 further including a center divider supported by said housing for dividing said storage compartment between an upper compartment and a lower compartment.

3. An apparatus as set forth in claim 2 wherein said center divider includes a full bobbin opening for dispensing a full bobbin from said top slide to said lower compartment and said second opening.

4. An apparatus as set forth in claim 3 wherein said center divider includes an empty bobbin opening for depositing an empty bobbin from said lever channel to said lower compartment.

5. An apparatus as set forth in claim 4 further including a bottom slide extending between said second opening and said full bobbin opening for transporting a full bobbin from said top slide to said second opening.

6. An apparatus as set forth in claim 5 wherein said tray includes a release channel for depositing a full bobbin from said tray to said top slide.

7. An apparatus as set forth in claim 6 further including an accommodator bracket for connecting said accommodator to said actuator lever and aligning said accommodator with said release channel to engage and orient the full bobbins with the top slide.

8. An apparatus as set forth in claim 7 wherein said release hinge includes a valve operatively coupled to said actuator lever for movement between a closed position in cooperation with a full bobbin in said top slide with said actuator lever in said extended position and an open position to release a single full bobbin from said top slide in response to the dispensing of an empty bobbin into said first opening and said lever channel and actuation of said actuator lever from said extended position to said actuated position.

9. An apparatus as set forth in claim 8 wherein said release hinge includes a bar for supporting said valve in said top slide and an actuation rod for coupling said bar and valve with said actuator lever to open and close said valve in response to sliding movement of said actuator lever between said extended position and said actuated position.

10. An apparatus as set forth in claim 9 further including a lever spring coupled between said lever channel and said actuator lever for biasing said actuator lever to said fully extended position.

11. An apparatus as set forth in claim 10 further including an actuation spring coupled between said lever channel and said actuation rod for biasing said valve to said closed position.

12. An apparatus as set forth in claim 11 wherein said valve includes a minor portion and a major portion spaced from said minor portion, each projecting from said bar into said top slide wherein said major portion retains a single full bobbin in said top slide in said closed position and said minor portion retains the remaining full bobbins in said top slide in said open position while the single bobbin is release by the major portion.

* * * * *